US006879295B2

(12) United States Patent
Taylor

(10) Patent No.: US 6,879,295 B2
(45) Date of Patent: Apr. 12, 2005

(54) ANTENNA ALIGNMENT METHOD AND DEVICE

(75) Inventor: Bryan W. Taylor, Ipswich (GB)

(73) Assignee: British Telecommunications public limited company, London (GB)

( * ) Notice: Subject to any disclaimer, the term of this patent is extended or adjusted under 35 U.S.C. 154(b) by 0 days.

(21) Appl. No.: 10/477,919

(22) PCT Filed: Jun. 12, 2002

(86) PCT No.: PCT/GB02/02657

§ 371 (c)(1),
(2), (4) Date: Nov. 18, 2003

(87) PCT Pub. No.: WO02/101873

PCT Pub. Date: Dec. 19, 2002

(65) Prior Publication Data

US 2004/0155827 A1 Aug. 12, 2004

(30) Foreign Application Priority Data

Jun. 13, 2001 (EP) ..... 01305123

(51) Int. Cl.[7] ..... H01Q 3/00

(52) U.S. Cl. ..... 343/757; 343/765; 343/766; 343/882

(58) Field of Search ..... 343/757, 765, 343/766, 878, 880, 882

(56) References Cited

U.S. PATENT DOCUMENTS

| | | | | |
|---|---|---|---|---|
| 4,563,687 A | | 1/1986 | Berger | 343/882 |
| 4,918,363 A | | 4/1990 | Hollis et al. | 318/626 |
| 5,077,561 A | * | 12/1991 | Gorton et al. | 342/359 |
| 5,999,139 A | * | 12/1999 | Benjamin et al. | 343/765 |

FOREIGN PATENT DOCUMENTS

| | | |
|---|---|---|
| EP | 0266026 A | 5/1988 |
| EP | 0678929 A | 10/1995 |

* cited by examiner

*Primary Examiner*—Hoang V. Nguyen
(74) *Attorney, Agent, or Firm*—Nixon & Vanderhye P.C.

(57) ABSTRACT

Radio antennas are aligned with each other for the creation of a fixed radio link, by temporarily mounting a powered actuator on an antenna forming one end of the link, the actuator being arranged to adjust the alignment of the antenna, controlling the movement of the actuator over a range of alignments, measuring the variations in the properties of a signal transmitted over the link as the actuator is moved, identifying an optimum actuator position, and locking the actuator in the optimum position. By using a powered antenna, it is possible to control the alignment of several antennas from a single convenient location. Once the antenna has been secured in the selected position the powered actuator may be recovered for use elsewhere.

16 Claims, 4 Drawing Sheets

ANTENNA ALIGNMENT METHOD AND DEVICE

This application is the US national phase of international application PCT/GB02/02657 filed 12 Jun. 2002 which designated the U.S.

This invention relates to radio antenna systems and in particular to a method for aligning antennas with each other for the creation of a fixed radio link.

Typically, a radio link is set up between two points by mounting an antenna on a tower or other structure at each point and then adjusting the orientation of each antenna in turn, in both elevation and azimuth to find the optimum alignment. In a typical installation there are two or more antennas at each end of the link, and for each transmitting antenna a selection can be made as to the optimum antenna to operate as the receiver.

Each such test requires a large number of personnel, in particular riggers to physically adjust the antennas' alignments, and commissioning engineers to take the necessary measurements. A typical operation requires the physical movement of the antenna relative to its mount by turning a locating screw with a spanner whilst monitoring for the optimum signal level. This is not a task that can be carried out with great precision, especially since the location of the antenna is usually necessarily in an exposed location. It is also not possible in practice to test both directions of transmission simultaneously, in particular because this would require riggers to be working too close to a transmitting antenna. In practice, riggers are required to descend the antenna tower between test transmissions. It is also necessary to test the link at various different frequencies within the bandwidth over which the antenna is to operate. The process is therefore very time consuming. Over the duration of the process, variations in environmental conditions such as the weather can affect the properties of the signals and mask the looked-for variations in signal strength caused by the adjustments in alignment.

With the increasing use of high speed digital communications, improved signal quality is required. However, the higher frequencies (in the Gigahertz band) now being used require greater accuracy in alignment. There is also more variation in signal strength due to environmental conditions—for example at these frequencies the wavelength is comparable with that of waves on the surface of the sea, so sea conditions can interfere with signals. Moreover, attenuation by liquid water is significant at these frequencies, so clouds or rain can affect the results.

It is therefore desirable to develop a test process which can be performed rapidly enough for an optimum alignment to be determined in a period short enough for weather and other environmental conditions to be substantially constant. A reduction in the number of personnel required, particularly for the unpleasant and potentially hazardous job of climbing an antenna tower to physically adjust the antenna alignments, would also be desirable.

According to the invention there is provided a method for aligning radio antennas with each other for the creation of a fixed radio link, comprising the steps of mounting powered actuators on antennas forming each end of the link, the actuators being arranged to adjust the alignments of the antennas, and to be replaced by fixed securing means subsequent to the alignment process,the alignment process being performed from a remote position and comprising the steps of:

controlling the movement of the actuators to adjust the antenna alignments, continuously measuring the variations in the properties of a signal transmitted over the link as the actuators are moved to adjust the alignment of the antennas;

identifying an optimum set of actuator positions, and fixing the antennas in the optimum positions.

According to a second aspect of the invention, there is provided apparatus for aligning radio antennas with each other for the creation of a fixed radio link, the apparatus comprising one or more powered actuators, each having means for mounting on an antenna such that it can adjust the alignment of the antenna, actuator securing means for temporarily securing the actuators to the antennas to allow their subsequent recovery and re-use, control means for controlling the movement of the or each actuator to vary the alignments of the antennas, measurement means for measuring properties of a signal transmitted over the link, means for allowing identification of an optimum actuator position, locking means for fixing the antennas in the optimum position, means for operating the control means and locking means, and monitoring the measurement means, from a position remote from the actuators.

Two or more actuators may be provided on the same antenna, for controlling orientation in two dimensions. In a preferred arrangement, signal quality is monitored continuously as the alignment of an antenna is adjusted, an optimum alignment position is identified, and the antenna is then positioned in the so-identified optimum alignment by means of the actuators. The means to lock the position of the antennas may be incorporated in the actuators or by separate locking means.

As will be described in relation to the preferred embodiment, the invention may be used for aligning the members of an array of antennas at one location with those of a corresponding array at another location By arranging for the antennas to be adjusted by powered actuators it is possible for the entire process to be carried out by one operator, controlling the actuators at both ends of the radio link remotely. However, a suitable powered actuator such as an electric or hydraulic ram is expensive, and it would be costly to provide all antennas with such equipment which is only required for use in the alignment phase. Therefore, according to the invention, the actuators are designed for temporary attachment to the antennas, so that they can be replaced by a fixed securing means once alignment has been performed. They can then be re-used on further installation work. To this end, the actuators are preferably provided with clamps for securing to the antenna structure independently of the existing manual adjustment system with which most antennas are fitted, so that after alignment is completed the manual adjustment system can be used to secure the antenna in position before recovery of the actuators. This recovery process requires riggers to ascend the antenna tower, but is a much simpler and quicker job than the prior art alignment task, and can be performed at any convenient time after the adjustment process has been completed.

An embodiment of the invention will now be described, by way of example, with reference to the drawings, in which.

Figure 1:
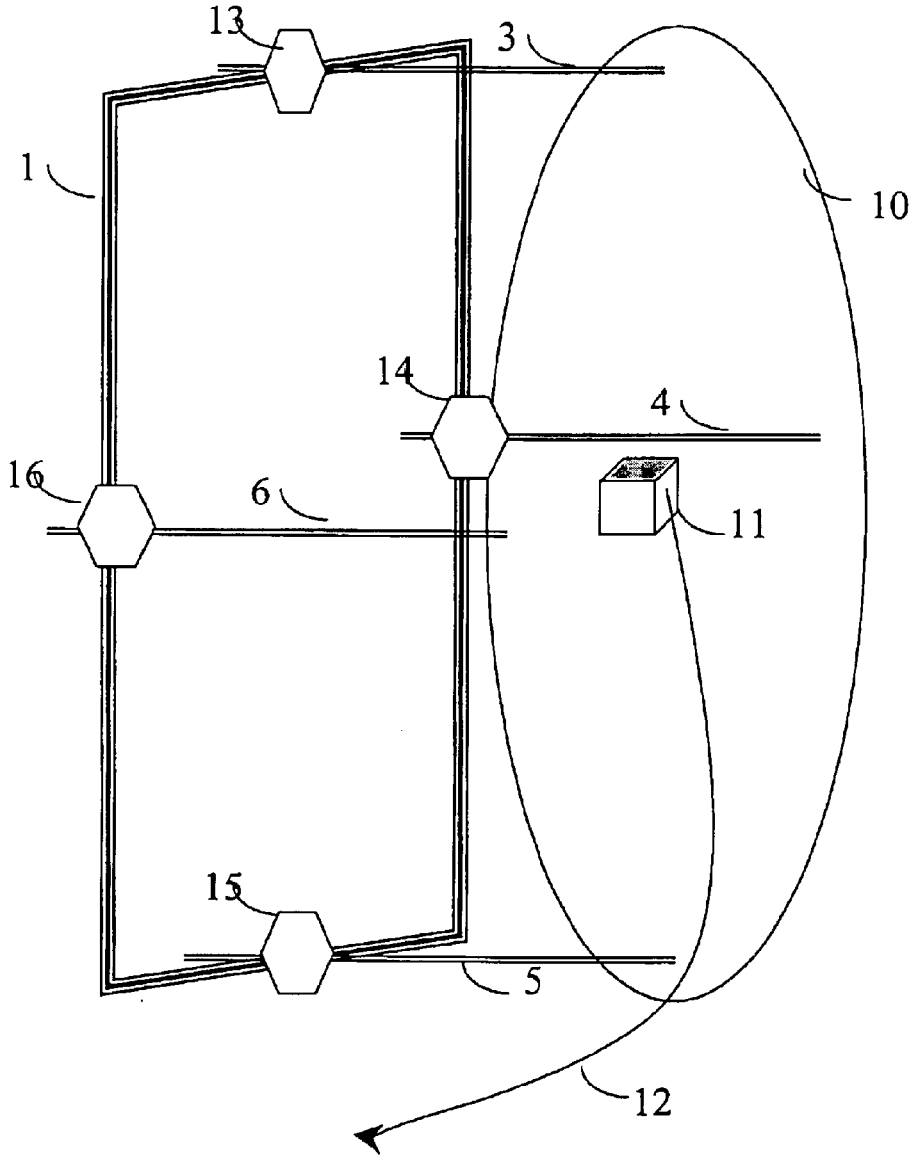
FIG. 1 illustrates a typical antenna, showing the mechanical alignment system.

FIG. 1 illustrates schematically a fixed frame 1 forming part of a mast, tower, or other fixed structure. Mounted on the frame 1 are several antennas 10, 20, 30 (see FIG. 3), of which one antenna 10 (viewed obliquely from the rear) is shown in FIG. 1. The antenna has a transceiver 11 which is supplied by means of an electrical lead 12. The antenna 10 is adjustably mounted on the frame 1 by means of four locating screws 3, 4, 5, 6 fixed to the antenna 10 and releasably connected to the frame 1 by means of respective locking clamps 13, 14, 15, 16. The angular position of the antenna 10 relative to the frame 1 can be adjusted by releasing one of the clamps 13, 14, 15, 16, operating one of the locating screws to move the antenna and then locking the screw in its new position by means of the clamp. For example, the antenna may by rotated about a vertical axis defined by the clamps 13, 15 by releasing the clamps 14, 16, adjusting the orientation of the antenna by operating one of the respective locating screws 4 (the other screw 6 being free to move in the complementary direction with respect to its clamp 16) and then locking the screws 4, 6 in their new positions using the clamps 14, 16. Adjustment about a transverse horizontal axis defined by the clamps 14, 16 can be performed in a similar manner by adjusting the screws 3, 5.

The signal strength received by the transceiver 11 from a second antenna (whose own alignment may have been adjusted in a similar manner) can be monitored by a detector connected to the electrical lead 12. The process is repeated for the antennas at both ends of the radio link as many times as necessary to determine the optimum combination of antenna alignments. This process is cumbersome and time-consuming, requiring staff to be present at both the transmitting and receiving antennas. Adjustment has to be carried out on a trial and error basis, with the rigging crew responsible for carrying out the adjustments to the set screws having to move to a place of safety whilst each test is carried out, because of the strong radiation fields present close to an operational antenna. In a large installation with several antennas the duration of the process is long in comparison with changes in ambient conditions which may affect the results of the measurements.

Figure 2:
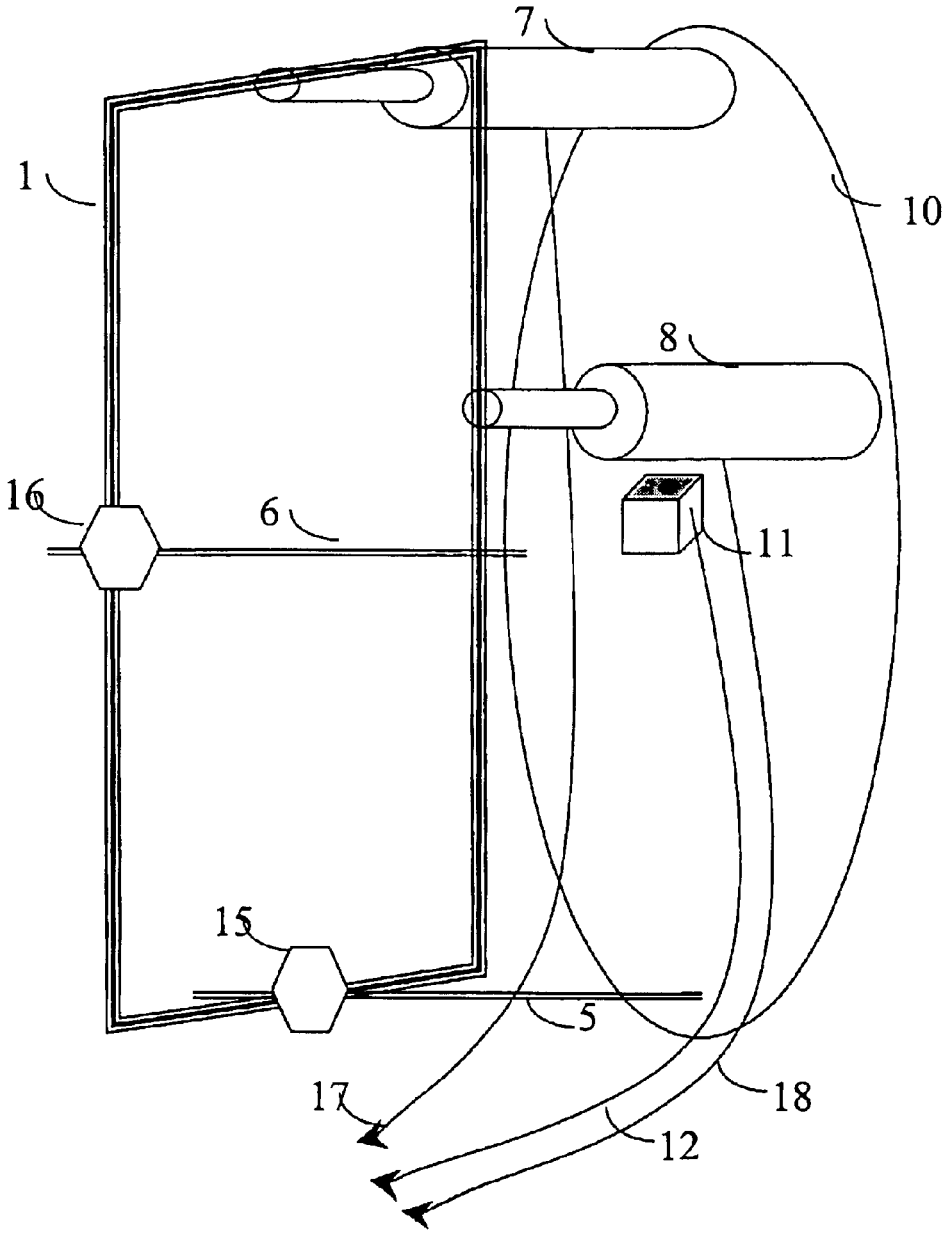
FIG. 2 illustrates the same antenna with powered actuators fitted according to the invention

FIG. 2 illustrates schematically an antenna assembly of the kind shown in FIG. 1, but fitted with alignment apparatus according to the invention. Two of the adjustment screws 3, 4 and associated clamps 13, 14 have been released or removed completely and in their place are respective powered actuators 7, 8 temporarily secured to the frame 1 and antenna 10 by brackets (not shown) fitted for the purpose. The actuators 7, 8 may be electrically or hydraulically powered rams, controlled (see FIG. 3) through respective control wires 17, 18 from a central location 7 (see FIG. 3), or by a wireless connection (not shown). The actuators 7, 8 may be used to continuously adjust the alignment of the antenna 10 relative to the frame 1 until an optimum arrangement is identified. The actuators 7, 8 are then returned to their optimum positions. A rigging crew can then return to the antenna 10 at a convenient time to re-instal the adjustment screws 3, 4, (without further adjusting the position of the antenna 10) and then recover the actuators 7, 8, and their control wires 17, 18 or wireless connection equipment, and the fixing brackets, for re-use on another installation project.

Figure 3:
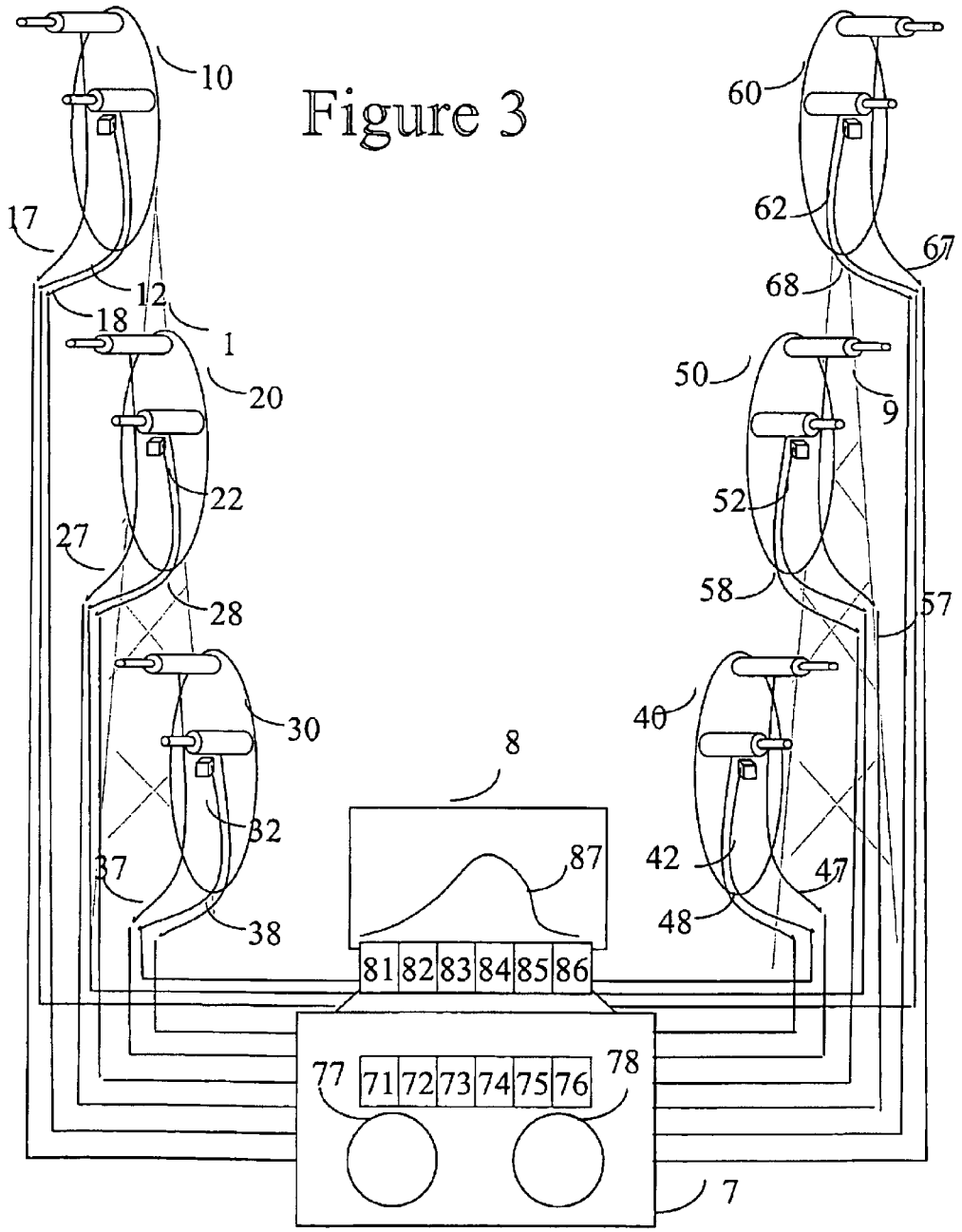
FIG. 3 illustrates an alignment system according to the invention, having six antennas each fitted as shown in the arrangement of FIG. 2

FIG. 3 shows a complete installation project comprising a first antenna array 10, 20, 30 mounted on a first tower 1, and a second antenna array 40, 50, 60 mounted on a second tower 9, which are arranged to be aligned with each other. As already shown in detail in FIG. 2 for antenna 10, each antenna 10, 20, 30, 40, 50, 60 is fitted with a pair of actuators having respective control leads 17,18; 27,28; 37,38; 47,48; 57,58; 67,68; and a lead 12, 22, 32, 42, 52, 62 from its respective transceiver.

The control leads are connected to a control unit 7, which may be placed at any convenient location. Although shown as fixed leads, wireless connections may be used, provided they do not interfere with the transmissions of the antennas under installation. As shown the control unit comprises two adjustment controls 77, 78 for adjusting the positions of the respective actuators 7, 8, and six selection switches 71–76 for connecting one of the pairs of control leads 17,18; 27,28; 37,38; 47,48; 57,58; 67,68 to the respective adjustment controls to select which antenna is to be to adjusted. Thus, if alignment of the antenna 40 is to be adjusted about the vertical axis the user selects the switch 74 (to connect control wires 47, 48 to the adjustment controls 77, 78), and then operates the adjustment control 78 to operate the actuator connected to the lead 48.

A monitoring unit 8 is provided which is connected to the transceiver of each antenna 10, 20, 30, 40, 50, 60 by its respective lead 12, 22, 32, 42, 52, 62. A series of switches 81, 82, 83, 84, 85, 86 is provided to allow the respective transceiver lead to be connected to an output 87, which displays signal strength, and provides the facility to carry out the following series of tests of signal quality against actuator position.

Panning in azimuth and elevation after identification of the main lobe 90

Cross-polar discrimination

Launcher (feed assembly) bi-polar tilts (for over-water hops)

Hop responses (using co-polar and cross-polar scalar measurements)

Figure 4:
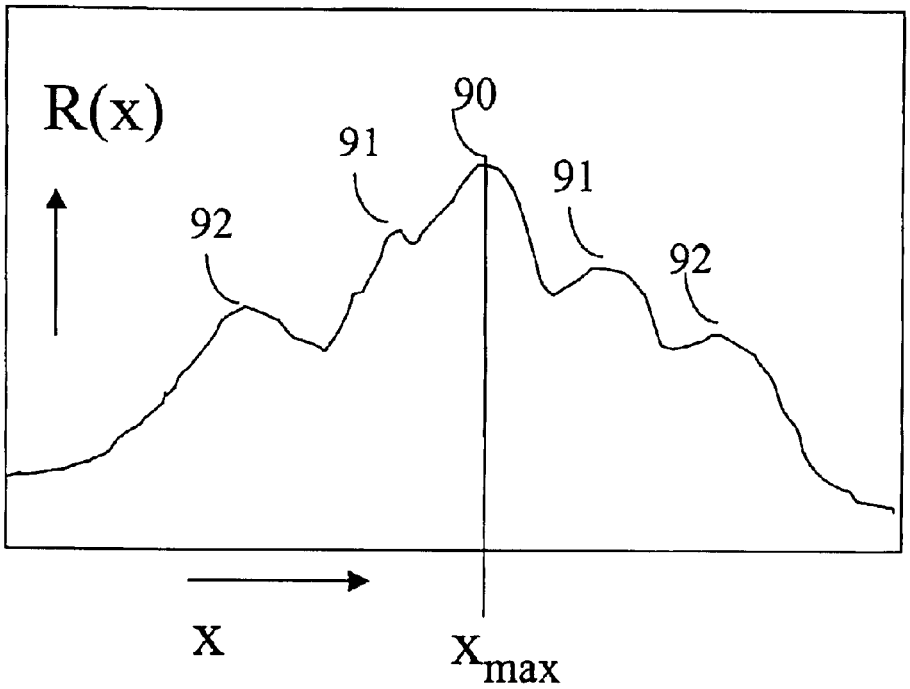
FIG. 4 is an illustrative plot generated during the process of the invention.

Test transmissions are made from the transceiver of one of the antennas 10 on the first mast 1 and received at the transceiver of one of the antennas 60 on the other mast 9 (or vice versa), whilst the position of one of the two antennas 10, 60 is being adjusted as described above. Thus if antenna 10 is to transmit to antenna 60 whilst the actuator 7 of antenna 10 is being operated, the user will select switches 71 and 86 and then operate controller 77. This will cause the elevation actuator 7 (FIG. 2) to travel through its range, causing the alignment of the antenna 10 to vary. As this happens the signal strength detected by the transceiver of antenna 60 will vary, and a plot of signal strength R(x) against actuator position x will be displayed on the display 87 of the monitoring unit. A typical such plot is shown in FIG. 4. After carrying out a wide pan, which will identify the main lobe 90 and side lobes 91, 92 shown in FIG. 4, the user can focus on the main lobe and repeats a narrow pan to identify from the plot the optimum actuator position $x_{max}$ at which R(x) is a maximum (90), corresponding to the main lobe of the antenna, and can then return the actuator 7 to this position using the controller 77.

The antenna can then be adjusted in azimuth by using the controller 78 to operate the other actuator 8. When the switch 71 controlling the actuators 7, 8 of antenna 10 is switched off, the actuators are locked so that antenna is then fixed in position.

It will be understood that the human operator in this embodiment may be replaced by a computer running an algorithm under the control of inputs 12, 22, 32, 42, 52, 62 from the transceivers 11, 21, 31, 41, 51, 61, to generate signals on the output connections 17,18, 27,28, 37,38, 47,48, 57,58, 67,68 for transmission to the respective actuators. As will be understood by those skilled in the art, any or all of the software used to implement the invention can be contained on various transmission and/or storage mediums such as a floppy disc, CD-ROM, or magnetic tape so that the program can be loaded onto one or more general purpose computers or could be downloaded over a computer network using a suitable transmission medium.

By concentrating all monitoring and control in one location, under the control of one person or computer, the alignment process is greatly simplified. Moreover, because the antenna alignment can be carried out remotely, transmissions do not need to be switched off whilst adjustments are made as would be necessary for safety reasons if a rigging crew had to be present to perform those adjustments manually. This allows signal quality to be measured continuously, rather than incrementally, greatly accelerating a process that could otherwise take several weeks (if several antennas on each mast have to be aligned) to be performed in a few hours. As well as the manpower efficiencies achieved by this acceleration, enhanced accuracy is achieved because environmental conditions which may influence signal quality are less likely to vary significantly during the shortened testing period.

What is claimed is:

1. A method for aligning radio antennas with each other for the creation of a fixed radio link, comprising the steps of mounting powered actuators on antennas forming each end of the link, the actuators being arranged to adjust the alignments of the antennas, and to be replaced by fixed securing means subsequent to the alignment process,the alignment process being performed from a remote position and comprising the steps of:

controlling the movement of the actuators to adjust the antenna alignments, continuously measuring the variations in the properties of a signal transmitted over the link as the actuators are moved to adjust the alignment of the antennas;

identifying an optimum set of actuator positions, and fixing the antennas in the optimum positions.

2. A method according to claim 1, wherein a computer controls the actuators in response to variations in the properties of the received signal, and identifies the optimum set of actuator positions.

3. A method according to claim 1, wherein two or more actuators are provided on each antenna, for controlling orientation in two dimensions.

4. A method according to claim 1, wherein the actuators are electric or hydraulic rams.

5. A method according to claim 1, wherein the actuators are controlled, and the signal property measurements received, by signals carried over a wireless communications link.

6. A method according to claim 1, wherein the antennas are fixed in position by locking the actuators.

7. A method according to claim 1, wherein the actuators are provided with clamps for securing to the antenna structure independently of the fixed securing means, so that the fixed securing means can be used to secure the antenna in position before recovery of the actuators.

8. A method according to claim 1, wherein a plurality of antennas at one location are aligned with a corresponding plurality of antennas at a second location according to the method.

9. A computer program or suite of computer programs for use with one or more computers to control the actuator in response to signal measurements as set out in claim 2.

10. Apparatus for aligning radio antennas with each other for the creation of a fixed radio link, the apparatus comprising one or more powered actuators, each having means for mounting on an antenna such that it can adjust the alignment of the antenna, actuator securing means for temporarily securing the actuators to the antennas to allow their subsequent recovery and re-use, control means for controlling the movement of the or each actuator to vary the alignments of the antennas, measurement means for measuring properties of a signal transmitted over the link, means for allowing identification of an optimum actuator position, locking means for fixing the antennas in the optimum position, means for operating the control means and locking means, and monitoring the measurement means, from a position remote from the actuators.

11. Apparatus according to claim 10, wherein the actuators are electric or hydraulic rams.

12. Apparatus according to claim 10, wherein the locking means comprise means for locking the actuators in position.

13. Apparatus according to claim 10, wherein the actuator securing means comprise clamps for securing to an antenna structure independently of a fixed antenna securing means, such that the fixed antenna securing means can be used to secure the antenna in position before recovery of the actuators.

14. Apparatus according to claim 10, comprising wireless communication means for transmitting commands from the control means to the actuators, and for transmitting measurement signals from the measurement means to the display means.

15. Apparatus according to claim 10, further comprising a computer for generating actuator control commands in response to measurements made by the measurement means, and for determining an optimum actuator position from said measurements.

16. Apparatus according to claim 10, further comprising display means for displaying variations in the signal properties against the operation of the control means, such that an optimum actuator position can be identified.

* * * * *